US008162811B2

(12) United States Patent
Clarke et al.

(10) Patent No.: US 8,162,811 B2
(45) Date of Patent: Apr. 24, 2012

(54) SYSTEM FOR PRODUCING A CROSS-FOLDED SHEET MATERIAL

(75) Inventors: Nicholas S. Clarke, Harpenden (GB); Daniel Everatt, Royston (GB); Mark Woodliffe, Welwyn Garden City (GB)

(73) Assignee: Pitney Bowes Ltd., Harlow, Essex (GB)

( * ) Notice: Subject to any disclaimer, the term of this patent is extended or adjusted under 35 U.S.C. 154(b) by 313 days.

(21) Appl. No.: 12/499,426

(22) Filed: Jul. 8, 2009

(65) Prior Publication Data

US 2010/0016138 A1 Jan. 21, 2010

(30) Foreign Application Priority Data

Jul. 18, 2008 (GB) ..... 0813265.6

(51) Int. Cl.
*B65H 45/12* (2006.01)

(52) U.S. Cl. ..... 493/421; 493/407; 493/415; 493/435; 493/445; 493/455

(58) Field of Classification Search ..... 493/407–409, 493/415, 419–421, 434, 435, 438, 443, 445, 493/446, 455, 459
See application file for complete search history.

(56) References Cited

U.S. PATENT DOCUMENTS 1,680,359 A * 8/1928 Baldwin et al. ..... 156/465
6,881,181 B2 * 4/2005 Brown et al. ..... 493/419
7,678,038 B1 * 3/2010 Stieber et al. ..... 493/442
7,736,290 B2 * 6/2010 Oshiro et al. ..... 493/424
2007/0275842 A1 * 11/2007 Tamura et al. ..... 493/419

* cited by examiner

*Primary Examiner* — Hemant M Desai
(74) *Attorney, Agent, or Firm* — Brian A. Collins; Charles R. Malandra, Jr.; Steven J. Shapiro

(57) ABSTRACT

A cross-fold system for use in combination with a device for folding sheet material and includes a rigid guide structure having a stationary reaction surface for supporting and guiding folded sheet material along a feed path between a sheet feed mechanism and a tensioning mechanism. Furthermore, the cross-fold system includes a paper break assembly disposed between the sheet feed mechanism and the tensioning mechanism. The paper break assembly, furthermore, includes an abrasion bar disposed transversely of the feed path and in opposed relation to the rigid guide. Moreover, the paper break assembly is repositionable from an active position to an inactive position such that, in the active position, the abrasion bar pressingly engages the sheet material against the stationary reaction surface of the guide assembly, and, in the inactive position, the abrasion bar permits the sheet material to pass to the tensioning mechanism without engaging the sheet material. When the paper break assembly is in the active position, the tensioning mechanism is operative to pull the folded sheet material across the abrading bar to yield the adhesive bond between the reinforcing fibers of the sheet material. As such, a subsequent cross-fold of the folded sheet material is facilitated.

6 Claims, 11 Drawing Sheets

SYSTEM FOR PRODUCING A CROSS-FOLDED SHEET MATERIAL

FIELD OF THE INVENTION

The present invention relates to folding apparatus for producing folded sheet material, and, more particularly, to a new and useful system and method for producing one or more cross-folds in a sheet material which has been previously folded, e.g., about an orthogonal fold line.

BACKGROUND OF THE INVENTION

In the context of mailpiece delivery, a "self-mailer" is a term used to define mailpieces which employ some portion of its content information or material to form a finished mailpiece, i.e., a mailpiece ready for delivery. In addition to certain efficiencies gained from the dual use of paper stock, i.e., as both envelope and content material, self-mailers mitigate the potential for disassociation of content material from the mailing envelope, i.e., preventing mail from being delivered to an incorrect address.

One example of a self-mailer includes a sheet of content material which has been folded, e.g., a bi- or tri-fold brochure or pamphlet and sealed along a free edge such that the destination address/postage may be printed on, or applied to, a backside surface of the content material. As such, the folded sheet functions dually as both an envelope for mailing purposes and as the substrate for conveying printed content/information.

The various postal services e.g., United States Postal Service (USPS) and Royal Mail, often impose certain criteria in connection with the creation of self-mailers to ensure that the folded sheets remain secure while being handled/processed by automated postal equipment, e.g., sorters, facers, cancellers, etc. One regularly accepted and historically reliable means for securing a self-mailer include the use of adhesive tabs folded over or extending across a free edge of the folded sheets. Generally, one or two tabs are adequate to secure the folded sheets at the center, or at each end thereof, to capture the free edges.

Conventional devices or systems for creating folded self-mailers typically include a folding station, a tabbing apparatus and a conveyor/stacker. The folding station accepts one or more sheets of printed content material and folds the sheet in a bi- or tri-fold, gate-fold or Z-fold configuration. The folded sheet is then fed to the tabbing apparatus where adhesive tabs are dispensed from a carrier substrate for precise placement along at least one free edge of the folded sheet. Generally, the tabbing apparatus can be configured to perform two types of tabbing operations. In one mode of operation, the tabbing apparatus is configured to perform "edge tabbing" wherein one or more tabs are folded over an edge of the sheets, i.e., into equal halves such that half of each tab secures a folded edge of the sheet(s). In another mode of operation, the tabbing apparatus is configured to perform "surface tabbing" wherein the tab or tabs are laid flat to secure the free edge of the folded sheet(s). That is, due to the manner in which the sheets are folded, the free edge of the folded sheet(s) is not disposed along an edge of the self-mailer, but rather located at a more central location, e.g., a gate-fold. As such, the tabs are not folded over along an edge of the self-mailer, but placed and pressed flat to secure a backside surface of a folded sheet together with a free edge thereof. Thereafter, the finished self-mailers are fed to a conveyor/stacker and stacked for subsequent traying operations.

While these apparatus/systems have successfully served the needs of large volume, mail service providers, several difficulties have persisted, particularly with respect to the efficacy of the fold line produced by the folding apparatus. Particularly problematic is sheet material which employ "cross-folds" wherein a subsequent fold line crosses over an initial or previously generated fold line, e.g., a subsequent fold line which is orthogonal to the initial cross-fold. These cross-folds become more difficult to produce when employing relatively stiff and/or thick sheet material such as may be used to fabricate high-quality marketing materials/literature. That is, due to the stiffness and/or thickness of the sheet material, the cross-fold can produce wrinkles which degrade the aesthetic appearance of the folded sheet material. Alternatively, the cross-fold can produce a local thickness concentration at the intersection of the fold lines and adversely impact the ability to retain the fold configuration of the sheet material.

In an effort to facilitate folding and/or closure of the sheet material about a cross-fold, one of two methods/systems is typically adopted. A first technique employs a conventional system of rollers which apply a high compaction pressure at the nip of the rollers to mitigate wrinkles and forcibly retain the fold configuration. Alternatively, the line about which the cross-fold will be produced is scored, i.e., severing fibers through a portion of the sheet material thickness, to facilitate subsequent folding operations. With respect to the use of compaction rollers, the nip between the rollers must be highly controlled, and as such, difficulties are encountered when folding sheet collations or sheet material which varies in thickness. With respect to scoring the sheet material, severing fibers can introduce stress concentrations at the fold line and the potential to tear the sheet material at the cross-fold. Furthermore, the induced stress concentrations can lead to premature failure of the fold line, i.e., causing the sheet material to tear following a relatively small number of cycles. Moreover, the scoring apparatus must be highly controlled to avoid cutting through the sheet material and introduces added complexity/cost to the folding apparatus.

A need, therefore, exists for a system and method for cross-folding sheet material which is reliable, does not require precise operation/control, and minimizes complexity/cost.

SUMMARY OF THE INVENTION

A cross-fold system is provided for use in combination with a device for folding sheet material. The cross fold system includes a rigid guide structure having a stationary reaction surface for supporting and guiding folded sheet material along a feed path between a sheet feed mechanism and a tensioning mechanism. Furthermore, the cross-fold system includes a paper break assembly disposed between the sheet feed mechanism and the tensioning mechanism. The paper break assembly, furthermore, includes an abrasion bar disposed transversely of the feed path and in opposed relation to the rigid guide. Moreover, the paper break assembly is repositionable from an active position to an inactive position such that, in the active position, the abrasion bar pressingly engages the sheet material against the stationary reaction surface of the guide assembly, and, in the inactive position, the abrasion bar permits the sheet material to pass to the tensioning mechanism without engaging the sheet material. When the paper break assembly is in the active position, the tensioning mechanism is operative to pull the folded sheet material across the abrading bar to yield the adhesive bond between the reinforcing fibers of the sheet material. As such, a subsequent cross-fold of the folded sheet material is facilitated.

BRIEF DESCRIPTION OF THE DRAWINGS

Further details of the present invention are provided in the accompanying drawings, detailed description, and claims.

FIGS. 6*a* and 6*b* are enlarged sectional views of a cross-fold system according to the present invention wherein FIG. 6*a* depicts a page breaker assembly in an open or idle position, and FIG. 6*b* depicts the breaker bar assembly in an operational position

DETAILED DESCRIPTION

The invention is directed to a system and method for producing a cross fold in a folded sheet material and will be described in the context of a mailpiece creation system. While the mailpiece creation system includes a folding station in combination with a tabbing apparatus for securing the free edges of the folded sheet, it will be appreciated that the invention is applicable to any folding apparatus which produces a folded article such as a brochure, pamphlet, or advertisement. That is, the invention is applicable to folding apparatus for any purpose irrespective of subsequent processing steps such as tabbing or placing the folded article into an enclosure such as an envelope.

Figure 1:
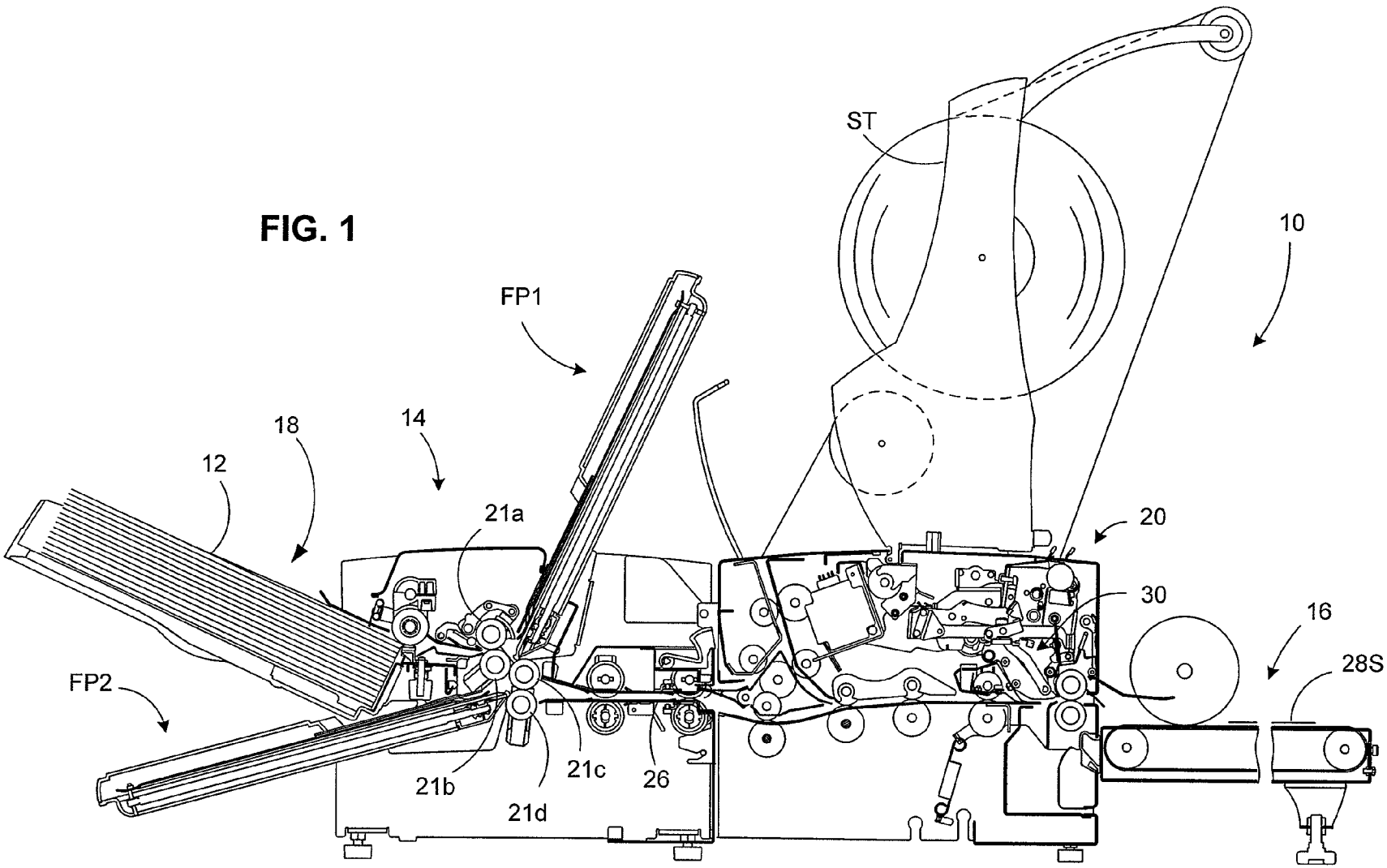
FIG. 1 is side sectional view of a mailpiece creation device including a folding device, a tabbing apparatus and a conveyor/stacker for fabricating, securing and collecting folded sheet material.

FIG. 1 depicts a mailpiece creation system 10 for fabricating, securing and collecting folded sheet material 12. The sheet material 12 may be a single sheet or a collation of sheets which are folded/stacked and secured along a free edge. The mailpiece creation system 10 includes a folding apparatus 14 operative to fold/cross fold sheet material into a desired configuration, a conveyer/stacker 16 for collecting sheets which have been folded and secured, and a tabbing apparatus 20 disposed therebetween for tabbing a free edge or edges of the sheet material 12, thus securing the folded sheet material 12 in the desired folded configuration. Before describing the system and method for producing cross-folds in a folded sheet material, a brief overview of the mailpiece creation system 10 is provided to obtain a general understanding of the fold requirements.

Figure 2A:
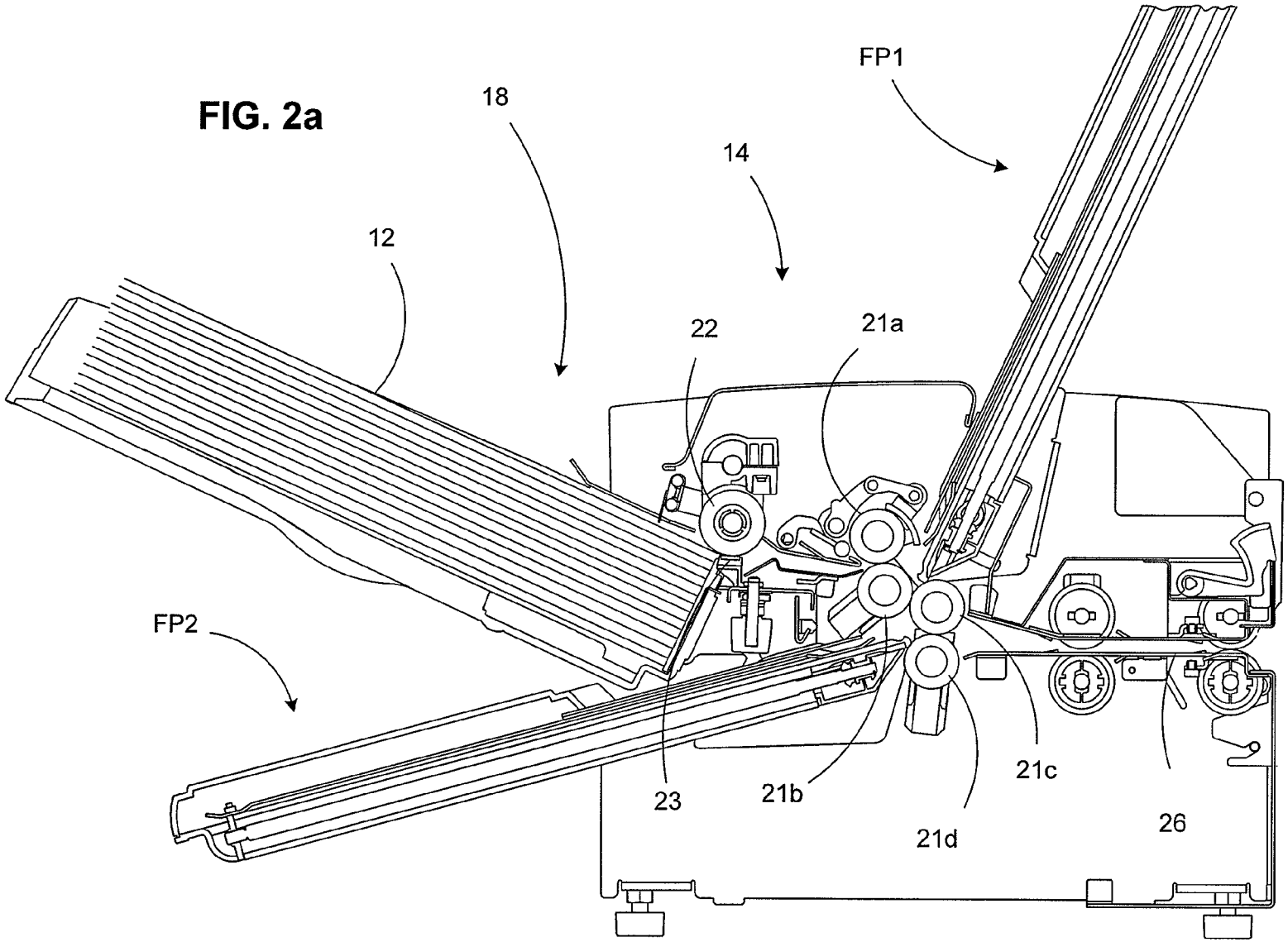
FIGS. 2*a* and 2*b* are enlarged side sectional views of the folding apparatus operative to fold the sheet material along various fold lines to produce a desired fold configuration.
Figure 2B:
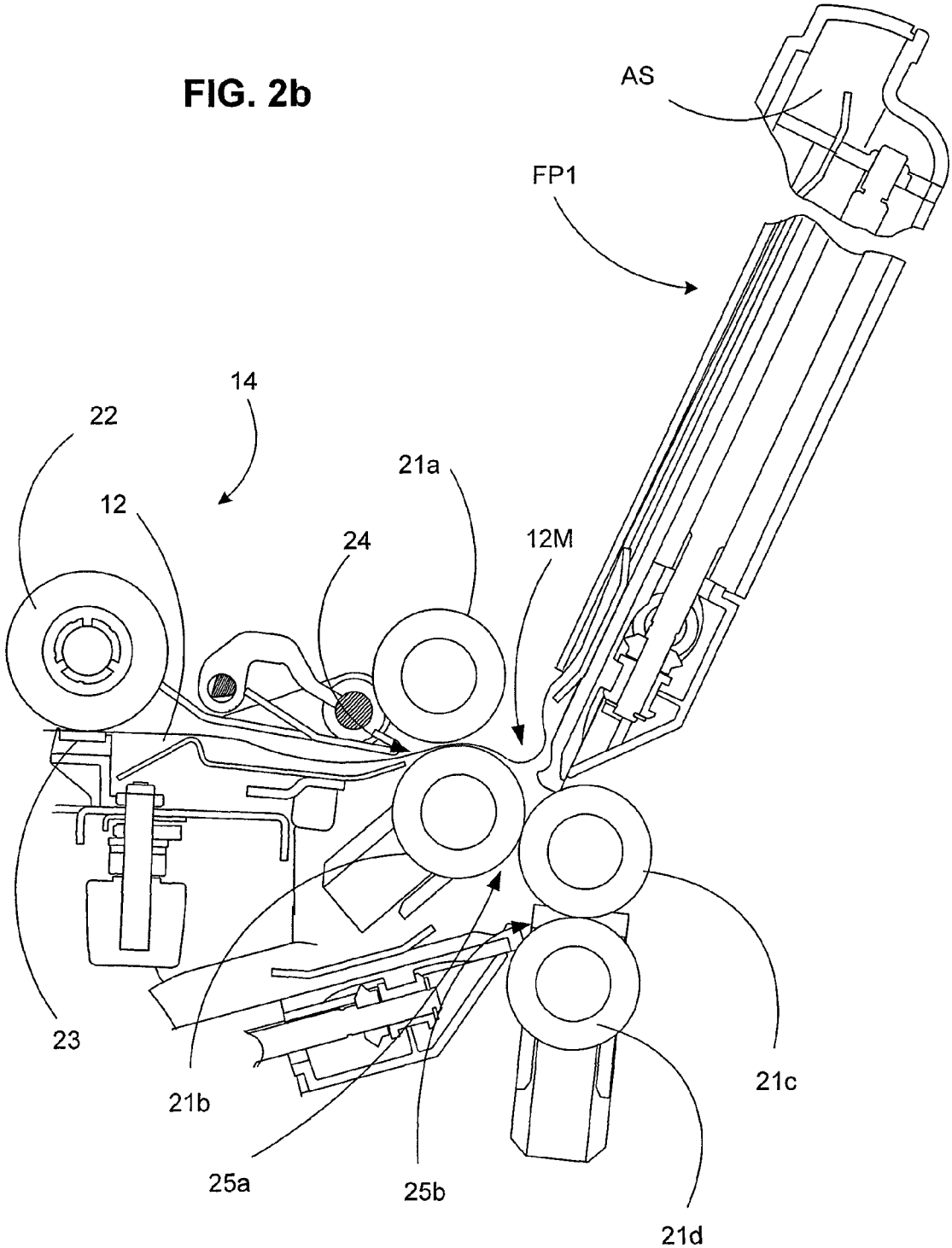

In FIGS. 2*a* and 2*b*, the folding apparatus 14 includes pairs of opposed rollers 21*a*-21*d* which produce folds as the sheet material 12 is redirected from one or more fold plates FP1, FP2. While folding apparatus 14 may include as few as two (2) rollers having a single (1) folding nip, others may include as many as six (6) rollers producing three (3) feed/folding nips. Generally, the more folding rollers/nips, the greater variety of fold configurations which can be produced. In the described embodiment, sheet material 12 is fed to an arrangement of four (4) rollers 21*a*, 21*b*, 21*c*, 21*d* by a separation feed roller 22 in combination with a retarding pad 23. Furthermore, the rollers 21*a*, 21*b*, 21*c*, 21*d* cooperate to produce a feed nip 24, and a pair of sequential folding nips 25*a*, 25*b*. Specifically, a forward pair of rollers 21*a*, 21*b* defines the feed nip 24, a central pair 21*b*, 21*c* defines a first fold nip 25*a*, and an aft pair 21*c*, 21*d* defines a second fold nip 25*b*. Viewed from yet another perspective, the rollers 21*a*-21*d* are arranged such that one of the forward feed rollers 21*b* produces a feed nip 24 at a first radial position and a fold nip 25*a* at a second radial position. Similarly, one of the fold rollers 21*c* produces a first fold nip 25*a* at a first radial position and a second fold nip 25*b* at a second radial position.

Folds are produced by buckling the sheet material in a controlled manner such that a buckled portion of the sheet enters one of the folding nips 25*a*, 25*b*. FIG. 2*b* shows the sheet material 12 being folded through the first fold nip 25*a* by the central pair of rollers 21*b*, 21*c*. More specifically, the sheet material 12 is fed into a first fold plate FP1 having an edge/end abutment surface AS disposed downstream or past the first fold nip 25*a*. As a leading edge portion of a sheet 12 engages the abutment surface AS, the forward rollers 21*a*, 21*b*, immediately upstream of the folding nip 25*a*, continue to feed the trailing edge portion of the sheet material 12 such that an intermediate portion thereof 12M, i.e., between the leading and trailing edge portions, buckles toward the folding nip 25*a*. As the buckled portion 12M grows, the folding nip 25*a* ingests and folds the sheet material along a fold line. The folded sheet material may be folded about a second fold line by feeding the sheet material into a second fold plate FP2 (see FIG. 2*a*). Similarly, the sheet material is buckled into the second fold nip 25*b* to produce the second fold line. For the purposes of maintaining consistency, the sheet material is identified by the reference numeral "12" before the sheet is folded, by the reference numeral "12P" when the sheet is partially folded (folded along a first fold line) and by the reference numeral "28" when the sheet is fully folded (e.g., cross-folded) and ready for tabbing operations.

Depending upon the number and/or operation of the opposed rollers 21*a*, 21*b*, 21*c*, 21*d*, a variety of folds may be introduced, though, the folding apparatus 14 will generally be used to effect bi- and tri-folded sheet material. Once a desired fold configuration is achieved, the folded sheet material passes to the tabbing apparatus 20 described in subsequent paragraphs.

Figure 3:
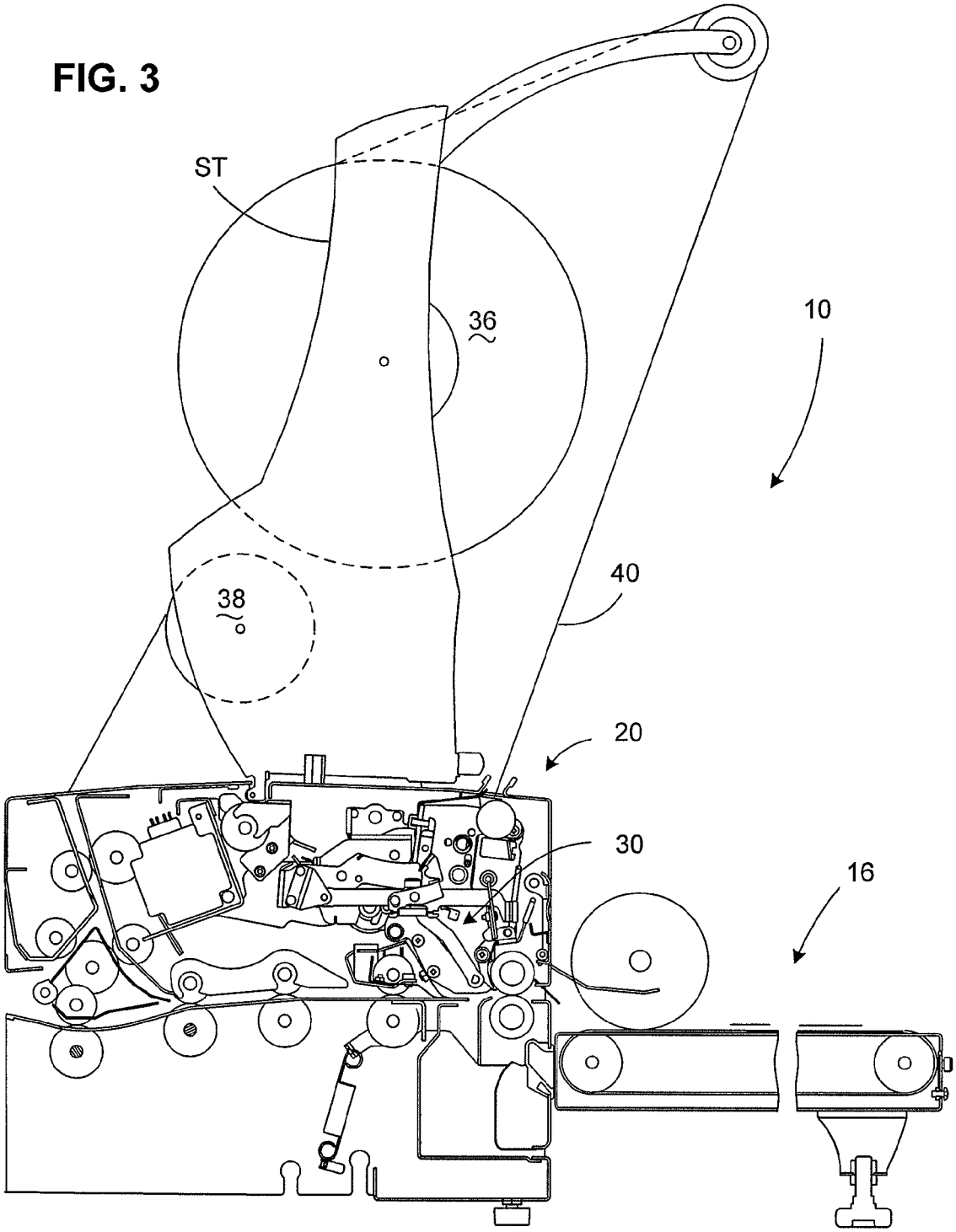
FIG. 3 is an enlarged side sectional view of the tabbing apparatus operative to receive the folded sheet material form the folding apparatus and dispense adhesive tabs along a free edge of the folded sheet material.
Figure 4:
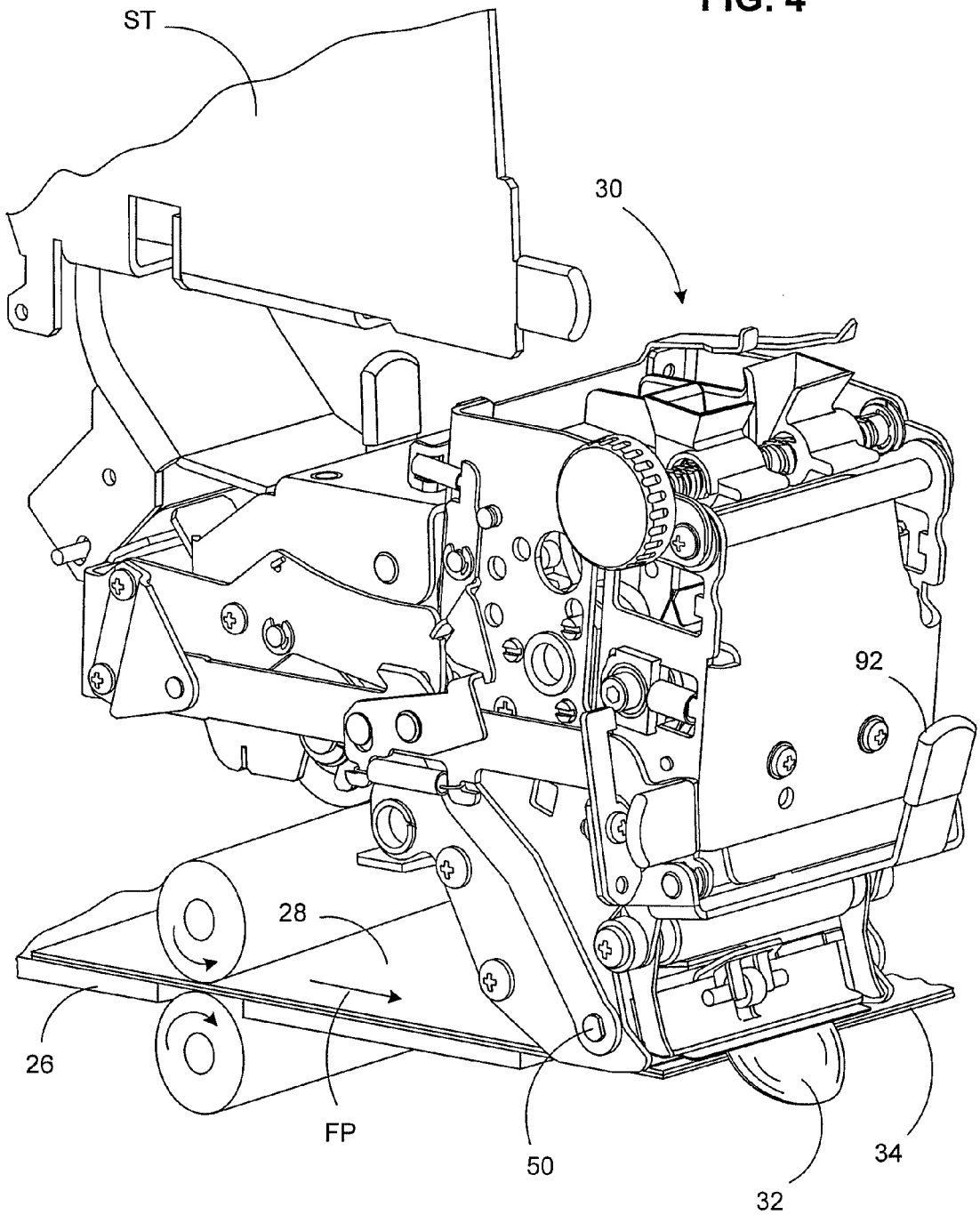
FIG. 4 is an isolated perspective view of the tabbing head wherein adhesive tabs are dispensed to secure the free edge of the folded sheet material.
Figure 5:
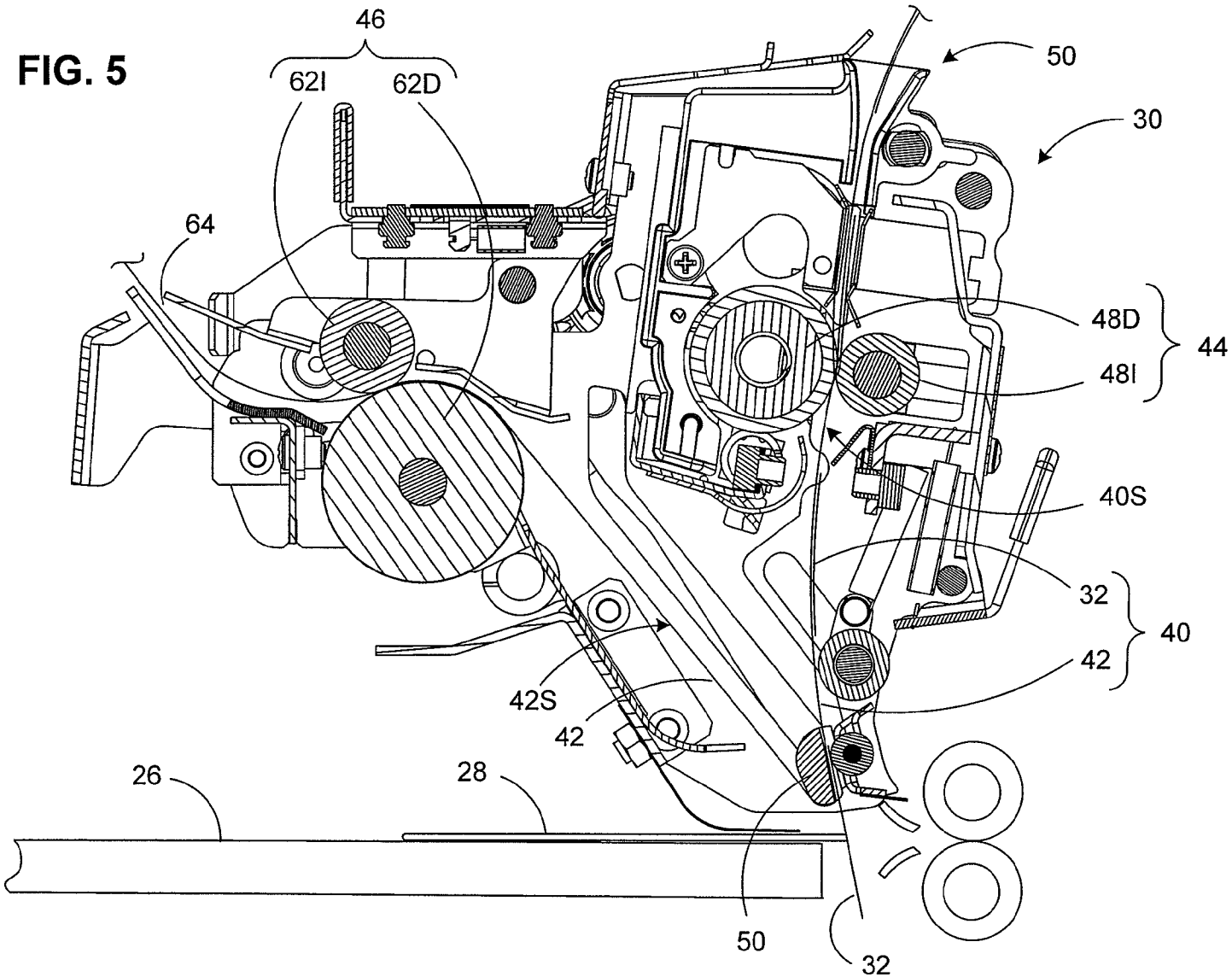
FIG. 5 is a side sectional view of the tabbing head including a peeler bar operative to abruptly change the direction of a stream of tab stock to dispense adhesive tabs from a carrier substrate.

In FIGS. 3, 4 and 5, the tabbing apparatus 20 includes an input conveyor or transport deck 26 for accepting and feeding the completed/finally folded sheet material 28 beneath a tabbing head 30 which is generally disposed above the input conveyor 26. For the purposes of clarity, a single tabbing head 30 is shown dispensing an adhesive tab 32 along a free edge 34 (best seen in FIG. 4) of the sheet material 28. Oftentimes, however, a pair of tabbing heads are disposed side-by-side to apply a pair of adhesive tabs along the free edge, i.e., proximal to each of side edge of the sheet material. Further, such dual tabbing heads are typically moveable along the length of the free edge 34 to allow variable spacing between the adhesive tabs 32.

The tabbing apparatus 20 also includes an input reel 36 (see FIG. 2) operative to supply tab stock 40 to the tabbing head 30, and an output reel 38 operative to take-away a carrier substrate 42 from the tabbing head 30. In the context used herein "tab stock" means any strip comprising at least one aligned row of adhesively-backed tabs 32 (see FIGS. 4 and 5) disposed on the carrier substrate 42. The strip of tab stock 40 may take the form of a web which is rolled or folded so as to form a plurality of elongate strips in a continuous Z-shaped stack. Generally, the adhesive tabs 32 are equally-spaced on the carrier substrate 42, circular in shape, and between about one-half inches (½") to about one and one-quarter inches (1¼") in diameter. Further, the carrier substrate 42 is often fabricated to produce a non-stick surface on the side containing the adhesive tabs 32 to facilitate the delivery of the tabs 32.

In FIGS. 4 and 5, the tabbing head 30 comprises a feeder or input mechanism 44 (see FIG. 5) operative to convey an input stream 40S of tab stock 40, an exit or output mechanism 46 operative to take-way an output stream 42S of carrier substrate 42 and a peeler bar 50 interposed between the input and output streams 32S, 42S for dispensing the adhesive tabs 32 from the carrier substrate 42. The tab stock 40 passes through a nip produced by the drive and idler rollers 48D, 481 of the feeder mechanism 44 and the input stream 40S of tab stock 40 extends downwardly toward the peeler bar 70. The input stream 40S slideably engages and wraps around several uniquely contoured surfaces of the peeler bar 50 to separate and dispense the adhesive tabs 32 from the carrier substrate 42. In terms of a broad functional description, the peeler bar 50 effects an abrupt change in direction with respect to the input and output streams 40S, 42S e.g., a directional change exceeding about seventy-five degrees (75°), such that the adhesive tabs 32 separate from the carrier substrate 42 and are dispensed along the free edge of the folded sheet material 28.

The output stream 42S of carrier substrate 42 then passes from the backside surface of the peeler bar 50 through a nip produced by the drive and idler rollers 62D, 62I of the output mechanism 46. Thereafter the carrier substrate 42 extends upwardly and outwardly through an exit channel 64. Finally, the output take-away reel 38 collects the carrier substrate 42 or waste material from the exit channel 64. A tabbing apparatus of the type discussed herein is more fully described in co-pending, commonly owned U.S. patent application Ser. No. 12/499,346, entitled "RECONFIGURABLE TABBING APPARATUS" filed on Jul. 8, 2009, and is herein incorporated by reference in its entirety.

Once tabbed, the secured mailpieces are placed on the conveyor/stacker 16 (see FIG. 1). The conveyor stacker 16 moves the secured mailpieces 28S away from the tabbing apparatus 20 and shingles the mailpieces as they collect against a wedge-shaped stop. The conveyor stacker 16 may include a sensor operative to cue an operator that the stacker 16 is approaching or has reached its load capacity. The mailpieces 28S are then manually removed and trayed by the operator.

Returning to our discussion of the folding apparatus 14, a cross-fold system 100 is incorporated therein which significantly improves the efficacy of cross-folds in a folded document/mailpiece. In the context used herein, a cross-fold refers to a fold-line produced subsequent to a previously-generated fold line and which "crosses" or forms an angle, i.e., acute, obtuse or right, relative to the original or first fold line. Generally, a cross-fold is orthogonal to the first fold line, but in the broadest sense of the definition, is any fold-line which crosses another fold line at any angle. Furthermore, it will be useful to understand that, in the described embodiment, the system and method for cross-folding documents/mailpieces employs a dual feeding operation. That is, sheet material is initially fed to the folding apparatus 14 to perform a first folding operation, e.g., to produce a tri-folded document having two (2) parallel fold lines. At this juncture, the partially folded sheet material 12P is passed through the mailpiece creation device 10 without performing a tabbing operation to secure the folded sheet material 28. Rather, the partially folded sheet material 12P is collected, e.g., by the conveyor/stacker 16, to be fed a second time through the folding apparatus 14 to produce a cross- or second fold line defining an angle with respect to the first fold line. Generally, the cross- or second fold will be orthogonal, or at right angles, relative to the first fold line, though there is no requirement to produce a right angle fold. Following the cross-folding operation, the tabbing apparatus 20 dispenses one or more adhesive tabs 32 to secure the free edge(s) of the cross-folded sheet material 28. As mentioned earlier, this may be an edge or surface tabbing operation.

Figure 6A:
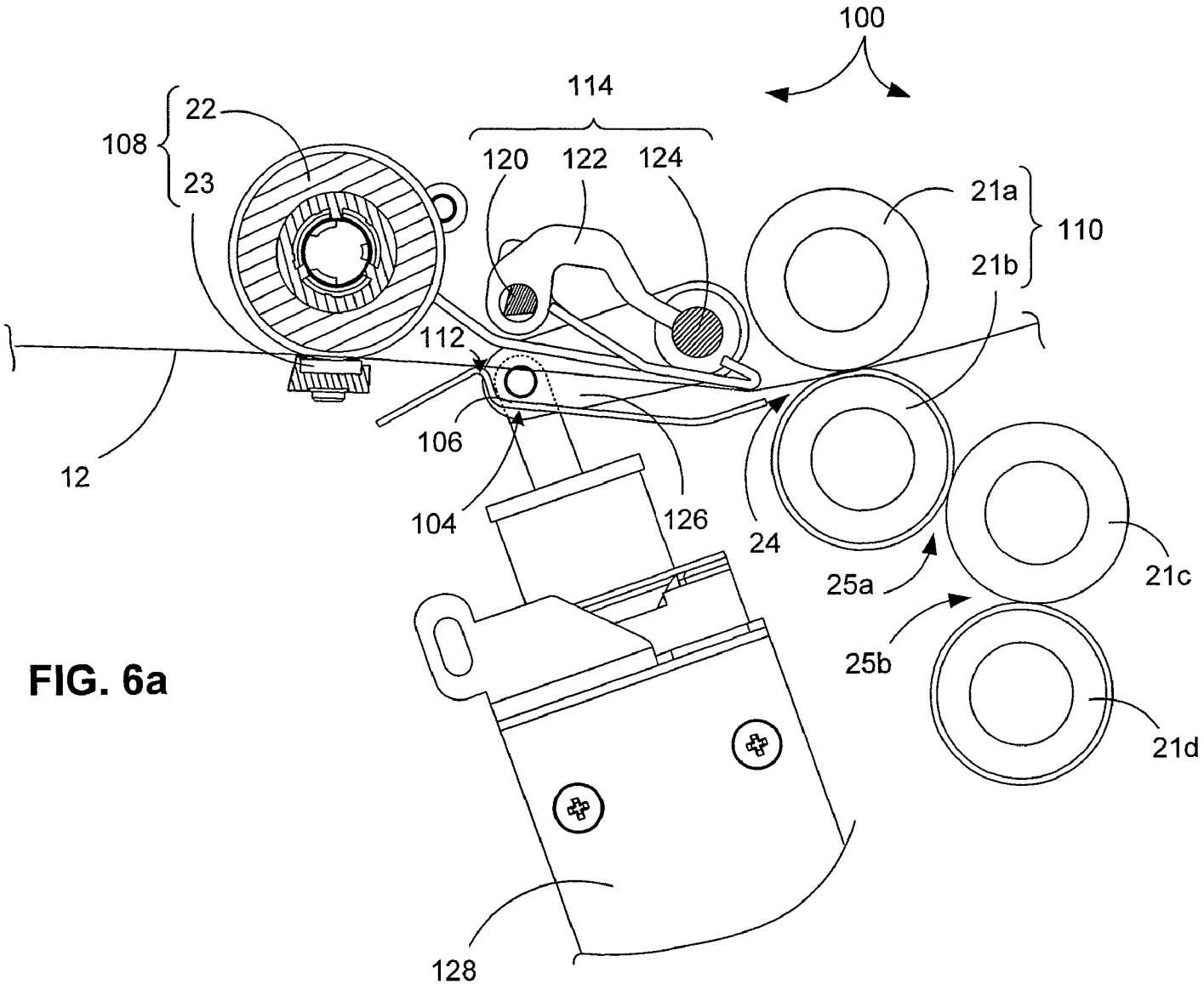
Figure 6B:
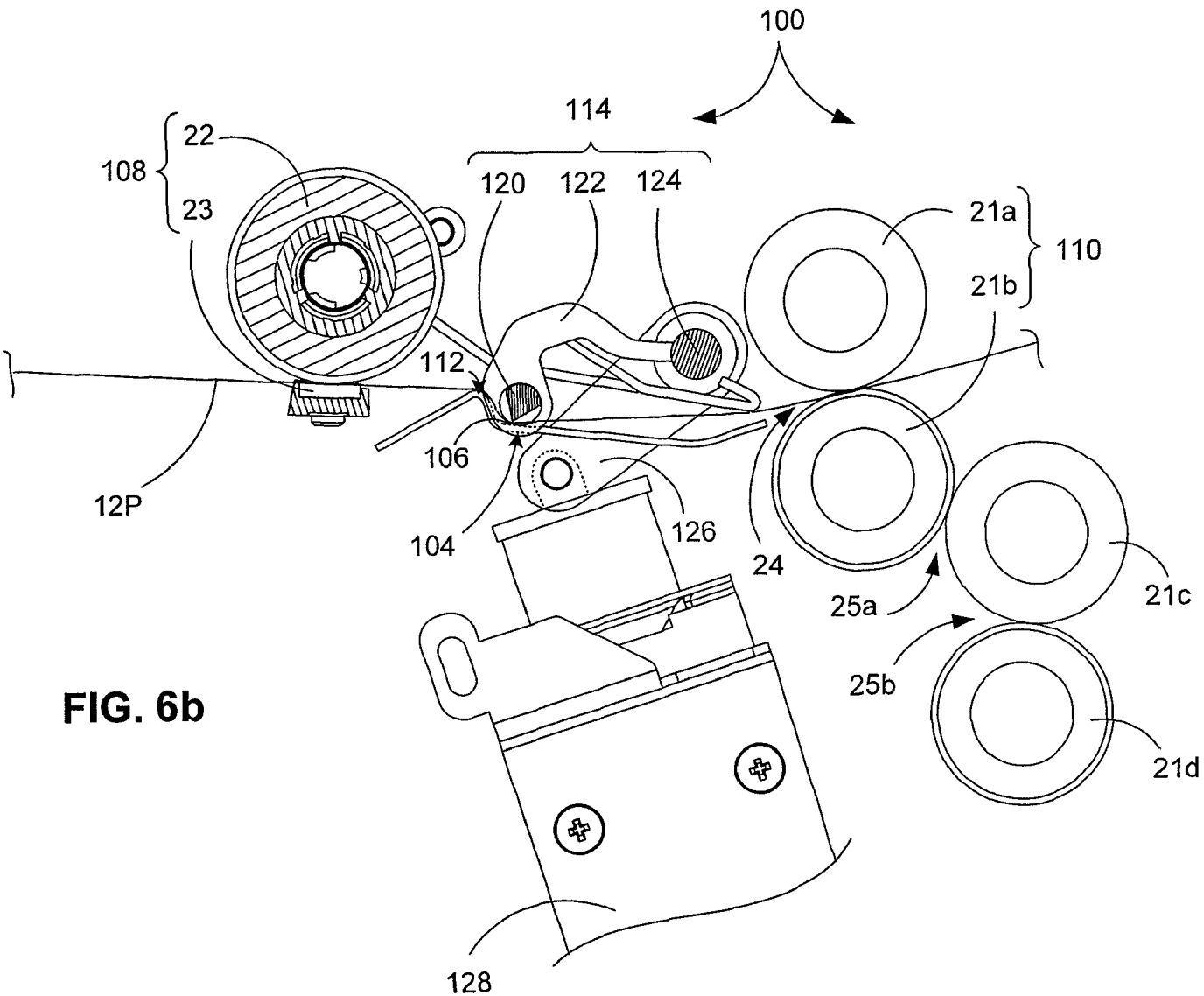

Before discussing the functional aspects of the inventive cross-fold system, a brief description of the various structural elements and there interaction is provided. In FIGS. 6*a* and 6*b*, the cross-fold system 100 of the present invention includes a rigid guide 104, a sheet feed mechanism 108, a tensioning mechanism 110 and a paper break assembly 114. The guide structure 104 includes a stationary reaction surface 106 for supporting and guiding folded sheet material along a feed path between the sheet feed mechanism 108 and the tensioning mechanism 110. In the described embodiment, the guide structure 104 includes a raised surface 112 to increase the surface length of the guide structure 104, i.e., the length along the feed path, relative to a straight line measured from the peek of the raised surface 112 to the tensioning mechanism 110. The raised surface 112 also ensures that the folded sheet material 28 assumes a prescribed shape in preparation for cross-folding operations. The advantage of this surface contour will become apparent when describing the cross-fold operation discussed in greater detail below.

The sheet feed mechanism 108 is operative to singulate unfolded sheet material 12 from a sheet feeder 18 (see FIG. 1), feed the sheet material 12 into the rigid guide 104 and convey the sheet material 12 to the tensioning mechanism 110. In the described embodiment, the sheet feed mechanism includes a conventional feed roller 22 and a retarding pad 23 to deliver/singulate sheet material 12 to the rigid guide 104. While the sheet feed mechanism 108 dually functions to both singulate and feed sheet material 12, it will be appreciated that, in the context of the cross-fold system 100 of the present invention, the sheet feed mechanism 108 functions to the convey sheet material 12 into the rigid guide and to the tensioning mechanism.

The cross-folding system 100 also includes a paper break assembly 114 disposed between the sheet feed mechanism 108 and the tensioning mechanism 110. The paper break assembly 114 includes an abrasion bar 120 which is supported at each end by a connecting arm 122. Each of the connecting arms 122 is affixed to a rotatable shaft 124 which, in turn, is supported at each end, and pivotally mounted to, a pair of side plates (not shown) of the folding apparatus 14. That is, the shaft 124 extends through journal mounts of the side plates or another mounting structure which permits the shaft 124, connecting arms 122 and abrasion bar 120 to rotate as a unit from a raised or inactive position (as shown in FIG. 6*a*) to a lowered or active position (as seen in FIG. 6*b*). The shaft 124 is, furthermore, connected to and rotated by an actuating link 126 which is connected at its opposite end to a linear actuator 128.

The tensioning mechanism 110 is operative to draw or pulling a folded sheet material in tension across the abrasion bar 120 when the paper break assembly is in its active position (shown in FIG. 6*b*). While the tensioning mechanism 110 may include a variety of devices to perform the intended function, the folding apparatus 14 of the present invention employs the forward feed rollers 21*a*, 21*b* in this capacity. That is, the forward feed rollers 21*a*, 21*b* function dually to (i) buckle sheet material during conventional folding operations and (ii) impart a tensile load to the folded sheet material 28 when the abrasion bar 120 is in its active position.

In operation, unfolded sheet material 12 is initially fed and singulated by the separator roller 23 in combination with the retarding pad 23. During this operation, the paper break assembly 114 is in a raised or inactive position as seen in FIG. 6*a*. More specifically, the linear actuator 128 rotates the shaft 124 in a clockwise direction to raise the connecting arms 122 and abrasion bar 120 in a direction away from the feed path of the sheet material (not yet folded). The sheet material 12 passes the paper break assembly 104 and enters the forward feed rollers 21*a*, 21*b* where the sheet material begins a conventional folding operation, e.g., to produce a conventional C-, Z- or gate fold configuration. Once this operation is completed, the partially folded sheet material 12P is collected and placed into the sheet feeder 18 (see FIG. 1) to begin cross-folding operations. It should be borne in mind, that during the first fold operation, the tabbing apparatus is inactive and the folded sheet material 12P is not secured by an adhesive tab 32.

The folded sheet material 12P is then placed in the sheet feeder 18 such that the folding nips 25*a*, 25*b* will produce a cross- or second fold (as defined hereinbefore) relative to the first fold line. To produce a right-angle cross-fold, the folded sheet material 12P will be fed such that first fold line is substantially parallel to the feed path defined by the folding apparatus 14. Once again, the folded sheet material 12P is singulated by the separator roller 23 and pad 23 and fed to the forward feed rollers 21*a*, 21*b* while the paper break assembly 114 is held in a raised or inactive position (FIG. 6*a*).

When the leading edge of the folded sheet material 12P is captured between the forward feed nip 24, the paper break assembly 114 is repositioned to its lowered or active position. That is, the linear actuator 128 rotates the shaft 124 in a counterclockwise direction to lower the connecting arms 122 and abrasion bar 120 in a direction toward the folded sheet material 28. The abrasion bar 120 pressingly engages the folded sheet material 12P immediately downstream of the raised surface 112 of the guide structure 104.

While in its active position shown in FIGS. 6*b*-through 8, the cross-folding system 100 simultaneously compacts the first fold line FFP and 12P to abrade the reinforcing fibers 130 of the sheet material 12P. More specifically, the abrasion bar 120 pressingly engages the face surface of the sheet material 12P while the tensioning mechanism 110 pulls the sheet material 12P across the abrasion bar 120. The abrasion bar 120 and tensioning mechanism 110, therefore, cooperate to compact the fold line FFP and yield the adhesive bond between reinforcing fibers of the sheet material 12P, i.e., in regions R1 and R2 (FIG. 8) of the drawings.

Figure 7:
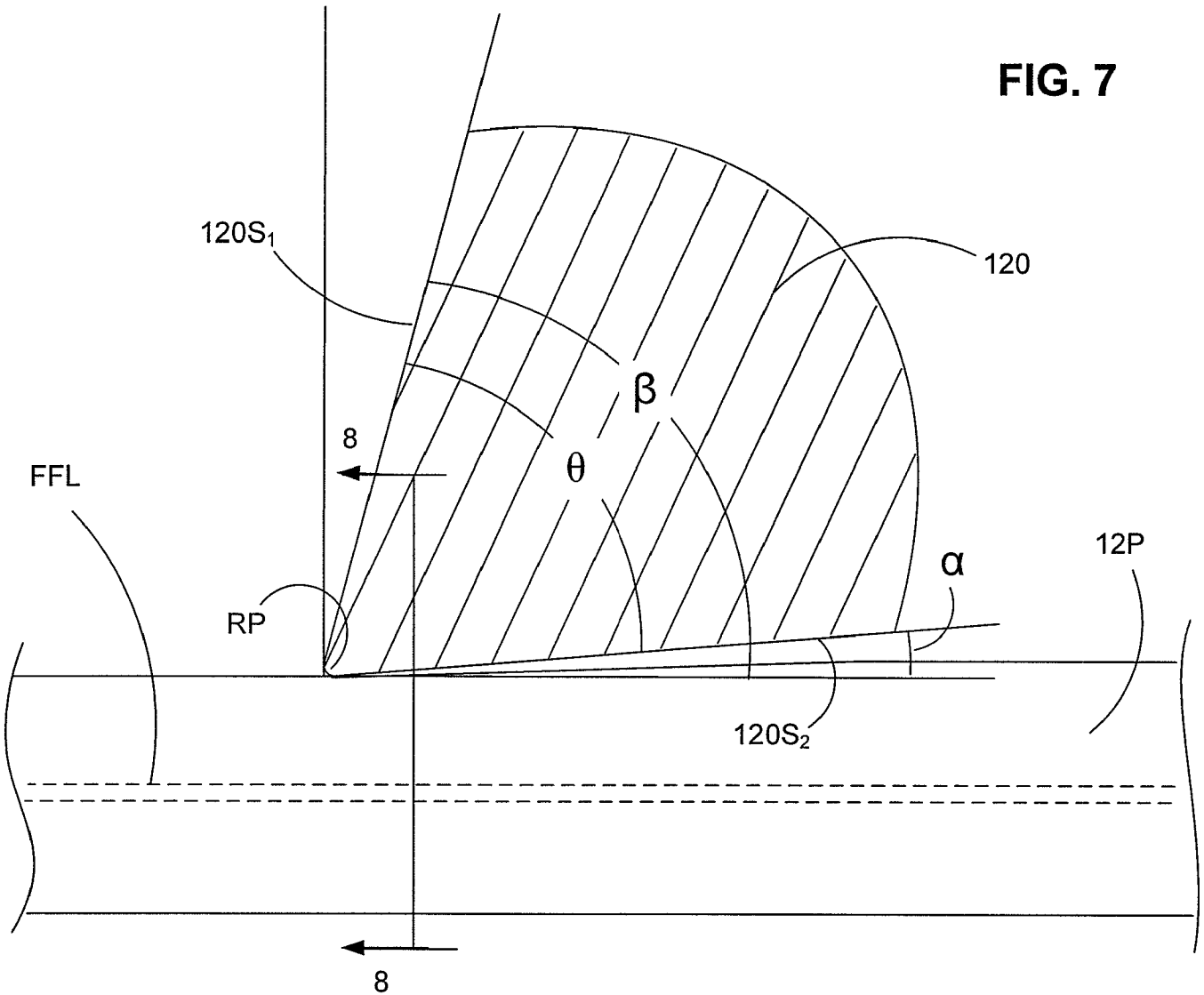
FIG. 7 depicts an enlarged sectional view of the breaker bar shown in FIGS. 6*a* and 6*b*.
Figure 8:
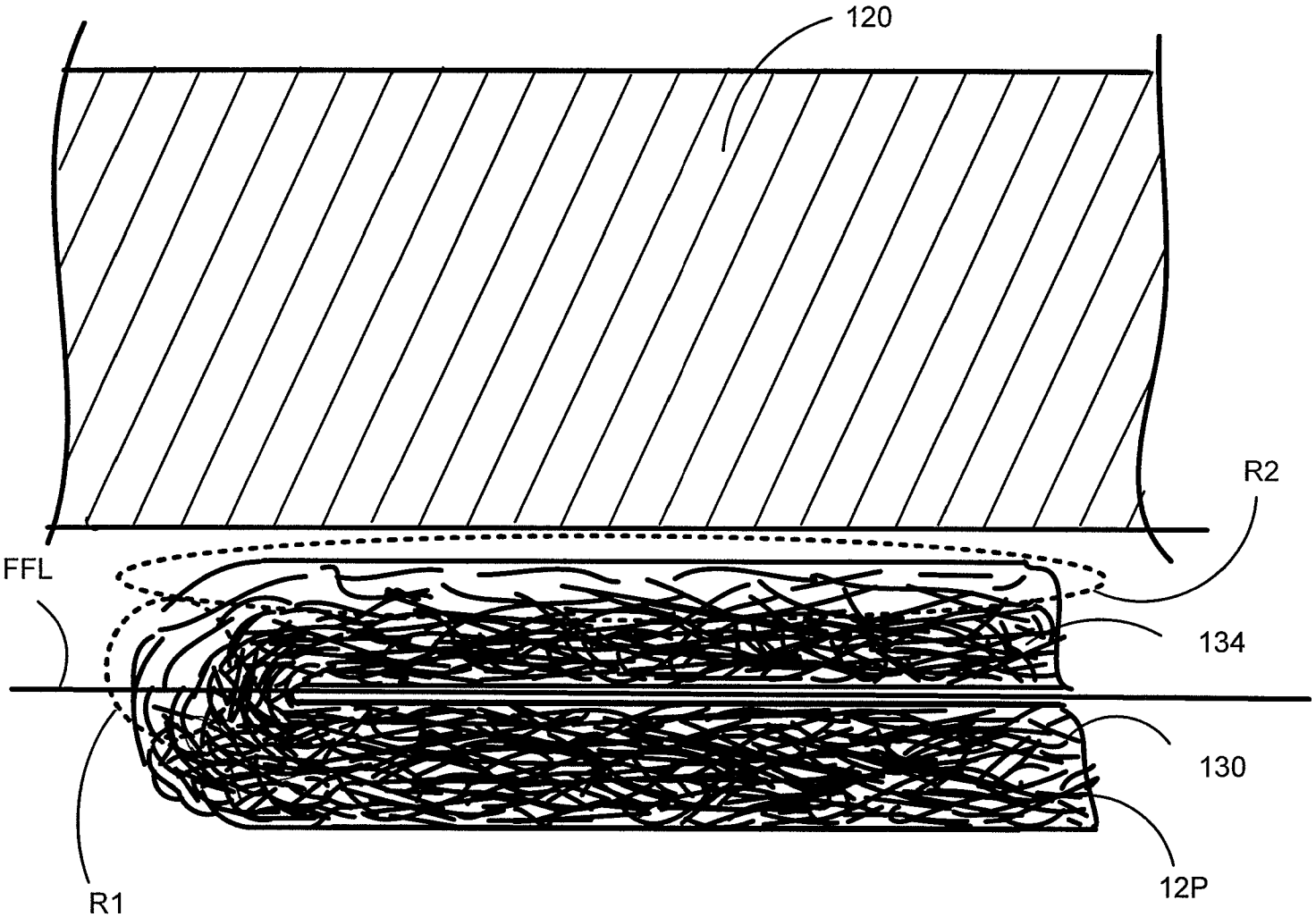
FIG. 8 depicts an sectional view taken substantially along line 8-8 of FIG. 7 to view the effect of abrading the sheet material by the page breaker assembly

To perform these functions, the abrasion bar 120 performs has a cross-section which defines a substantially V-shape. In FIGS. 7 and 8, the V-shape is formed by two planar surfaces $\mathbf{120}_{S1}$, $\mathbf{120}_{S2}$ which define an angle θ of between about sixty degrees (60°) to about eighty degrees (80°). Furthermore, a first of the planar surfaces $\mathbf{120}_{S1}$, $\mathbf{120}_{S2}$ defines a steep angle β of about seventy-five degrees (75°) relative to the horizontal and a second of the planar surfaces $\mathbf{120}_{S1}$, $\mathbf{120}_{S2}$ defines a shallow angle α of about seven and one-half degrees (7.5°) relative to the horizontal.

Figure 9:
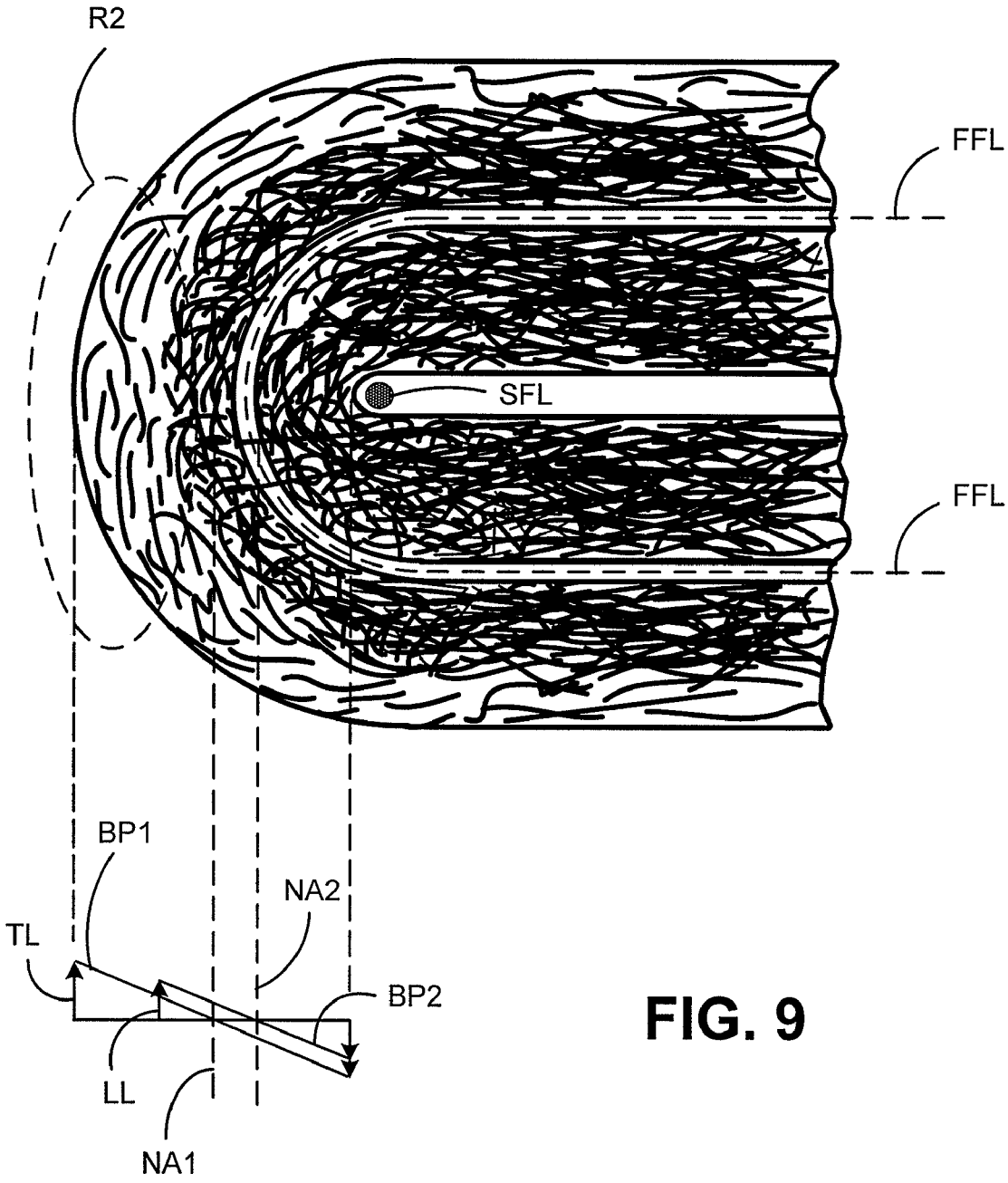
FIG. 9 depicts a sectional of sheet material which has been cross-folded by a second fold line and examines the bending moment profiles of sheet material which has been cross-folded in accordance with a prior art technique and sheet material which has been cross-folded using the system and method of the present invention.

The abrasion bar 120 applies a localized force to the sheet material 12P sufficient to yield the bond between the reinforcing fibers 130 and disrupt the binding matrix 134 of the sheet material 28. To prevent the abrasion bar 120 from cutting though the fibers 130, the planar surfaces $\mathbf{120}_{S1}$, $\mathbf{120}_{S2}$ converge to form a rounded point RP. In the described embodiment, the radius is on the order of between 0.05 mm to about 0.15, In FIG. 9, the sheet material 28 has been cross-folded such that the second fold SFL places the abraded fibers 130 in a tensile field, denoted by the encircled region R2, when bending the sheet material 28. A comparison is also drawn between the magnitude of bending stresses developed when the fibers 130 are bound within the binding matrix, i.e., not abraded, verses those developed when the fibers 130 are disrupted. That is, when the fibers 130 are bound within the matrix, a bending moment profile BP1 develops relative to a bending neutral axis NA1. Therein a peek tensile stress is developed at an outboard location denoted by arrow TL. When the fibers 130 are disrupted, a bending moment profile BP2 develops relative to its bending neutral axis. In this bending moment profile BP2, a peek tensile stress is developed at a second location denoted by arrow LL. By comparison of the peak tensile stresses TL, LL it will be appreciated that a lower tensile stress LL is developed in the bending moment profile BP2 inasmuch as the effective thickness and bending stiffness of the sheet material 28 is reduced by the disruption of fibers 130.

In summary, the folding apparatus employs a system and method for producing cross-folds in a folded sheet material. The system and method compacts and abrades the sheet material along a face surface thereof and in advance of performing a cross-fold operation. The system mitigates the requirement for costly, complex and highly precise equipment to produce cross-folds in a document/mailpiece.

While the cross-fold system is described as part of a two step process, i.e., feeding sheet material twice to obtain an initial and subsequent cross-folds, it should be appreciated that the folding apparatus could be adapted to perform both folding operations, with a single feed operation. That is, the folded sheet material could be self-fed or simply fed to a cross-fold system downstream of a first set of folding rollers.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

The invention claimed is:

1. A cross-fold system for use in combination with a device for folding sheet material, comprising:

a sheet feed mechanism operative to feed a folded sheet material;

a rigid guide having a stationary reaction surface for supporting and guiding the folded sheet material along a feed path between the sheet feed mechanism and a tensioning mechanism; and a paper break assembly disposed between the sheet feed mechanism and the tensioning mechanism and including an abrasion bar disposed transversely of the feed path and in opposed relation to the rigid guide, the paper break assembly, furthermore, being repositionable from an active position to an inactive position such that, in the active position, the abrasion bar pressingly engages the sheet material against the stationary reaction surface of the guide assembly, and, in the inactive position, the abrasion bar is inoperative to permit the sheet material to pass to the tensioning mechanism without engaging the sheet material;

the tensioning mechanism operative to pull the folded sheet material across the abrasion bar to yield the adhesive bond between reinforcing fibers of the sheet material when the paper break assembly is in is active position;

whereby yielding the adhesive bond between the reinforcing fibers facilitates a cross-fold of the folded sheet material.

2. The cross-fold mechanism according to claim 1 wherein the rigid guide structure defines a raised surface upstream of the active position of the paper break assembly to facilitate fiber abrasion of the sheet material.

3. The cross-fold mechanism according to claim 1 wherein the sheet feeder mechanism functions to singulate and feed sheet material to the rigid guide and convey the sheet material to the tensioning mechanism.

4. The cross-fold mechanism according to claim 1 wherein the tensioning mechanism includes a pair of forward feed rollers operative to induce tension in the sheet material in advance of performing a cross-fold operation and buckling of the sheet material for performing a subsequent fold operation.

5. The cross-fold mechanism according to claim 4 wherein one of the forward feed rollers produces a feed nip at a first radial position and a fold nip at a second radial position.

6. The cross-fold mechanism according to claim 1 wherein the abrasion bar of the paper break assembly includes planar surfaces defining a substantially V-shaped cross-sectional configuration, the planar surfaces converging to form a rounded point.

* * * * *